US005427604A

United States Patent [19]

Loving et al.

[11] Patent Number: 5,427,604

[45] Date of Patent: Jun. 27, 1995

[54] ALLOY MATERIAL ADDITION METHOD AND APPARATUS FOR SMELTING AND MELTING FURNACES

[75] Inventors: C. Gilmer Loving, Madison Heights; Eugene B. Bailey, Rustburg, both of Va.; Robert G. Peting, Oak Forest, Ill.

[73] Assignee: AMSTED Industries Incorporated, Chicago, Ill.

[21] Appl. No.: 160,943

[22] Filed: Dec. 3, 1993

[51] Int. Cl.[6] ..... C21B 13/02; C21B 7/16

[52] U.S. Cl. ..... 75/537; 266/81; 266/182; 266/216; 266/221; 266/267

[58] Field of Search ..... 266/81, 267, 182, 221, 266/216; 75/537

[56] References Cited

U.S. PATENT DOCUMENTS

| | | | |
|---|---|---|---|
| Re. 34,418 | 10/1993 | Bates et al. | 266/216 |
| 2,891,782 | 6/1959 | Blackman et al. | 266/182 |
| 4,030,894 | 6/1977 | Marlin et al. | 414/51 |
| 5,332,419 | 7/1994 | Lemay et al. | 75/533 |

OTHER PUBLICATIONS

"An Introduction to Blast Furnace Coal Injection" by I. F. Carmichael I&SM pp. 67–73 Mar. 1992.

"Coal Gets a New Shot" by George J. McManus *Iron Age* pp. 31, 32,36,38 Jan. 1989.

*Primary Examiner*—Melvyn J. Andrews

*Attorney, Agent, or Firm*—Edward J. Brosius; F. S. Gregorczyk; Thomas J. Schab

[57] ABSTRACT

A method and apparatus for feeding alloy additive and burden materials to the burden in a vertical shaft furnace working volume generally by gravity-feeding the alloy additive to the furnace tuyere for entrainment in the blast media and transfer to the burden, which improves the recovery rate of the charged additive components in the molten metal and, allows utilization of undersized materials without secondary handling and treatment of the feed materials or utilization of pneumatic feed apparatus.

22 Claims, 3 Drawing Sheets

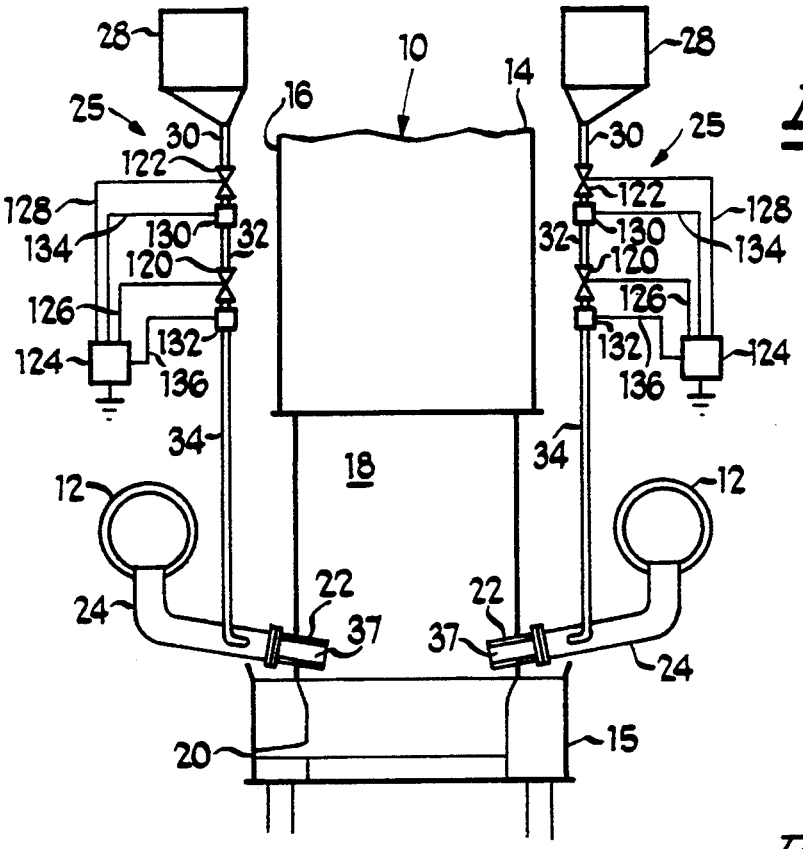
Fig 4
Fig 5
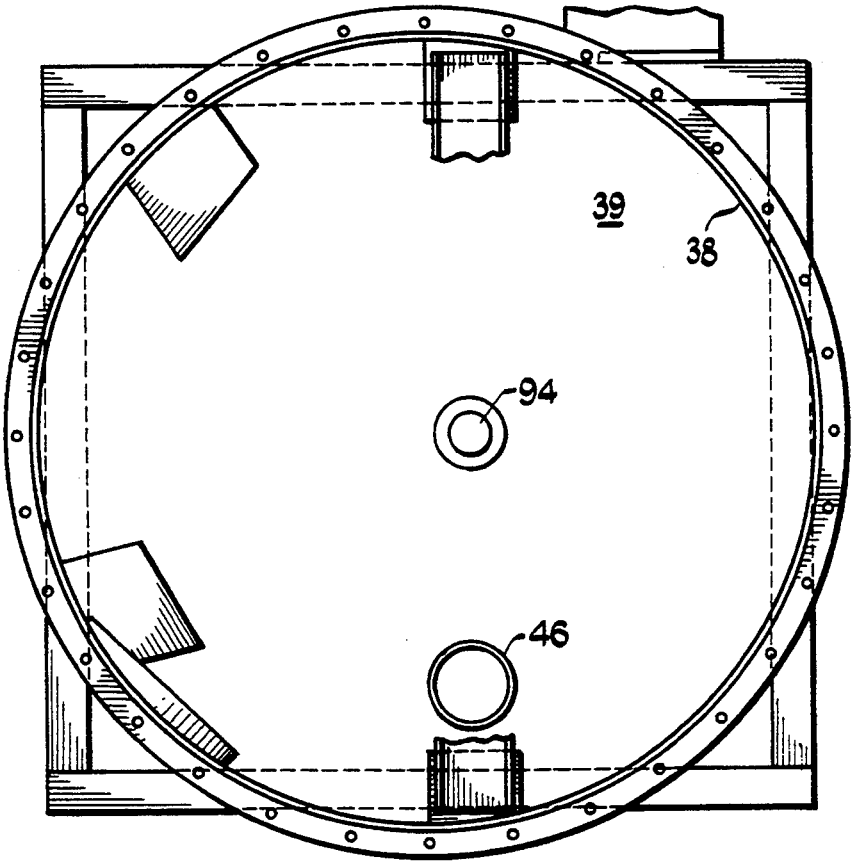

ALLOY MATERIAL ADDITION METHOD AND APPARATUS FOR SMELTING AND MELTING FURNACES

BACKGROUND OF THE INVENTION

The present invention is related to a feed method and apparatus for smelting and melting furnaces. More specifically, an additive feed apparatus is disclosed for tuyere-equipped, vertical-shaft furnaces, which apparatus utilizes a gravity feed method to obviate powered entrainment and transmission means, such as pneumatic injection apparatus. The additive-feed apparatus provides for the direct charging and utilization of various materials in vertical-shaft furnaces, such as blast furnaces and cupolas, which various materials are not usually utilized for direct introduction with the top-charged burden materials.

In both of the above-noted furnace types, the raw or burden materials are generally charged through the top of the furnace. In a blast furnace, the iron ore or iron-bearing charge material may consist of any of the forms or oxidation states of iron, which are reduced in a reducing atmosphere at elevated. temperatures. Although it is known that blast furnaces have been run without a pressurized top, modern furnace practices utilize pressurized furnaces with feed hoppers having a dual-bell system to maintain the internal furnace pressure during charge additions.

The chemical and thermodynamic reactions in the vertical-shaft furnace require a combination of materials in the burden including coke, iron-bearing materials and limestone. The coke is a multifaceted addition to this burden. It reacts with the oxygen in the blast air blown into the furnace to burn and provide the reaction heat, which blast air may be enriched with oxygen or other gasses. Coke combustion products include carbon monoxide, which acts to reduce the iron oxides to elemental iron particularly in the upper regions of the furnace. The hot gasses evolved during carbon combustion at the tuyere region preheat the burden materials at the upper reaches of the furnace, gasses at least partially dry and prereduce the other raw materials. The coke charge also has a mechanical function in the furnace reaction, as it must be able to sustain the overlying burden weight without being crushed, which preserves a path for ready flow of the gasses through the burden above the hearth.

The ores and other iron-bearing charge materials are not pure iron oxide but rather are frequently mineral bearing materials laden with extraneous or gangue components. Therefore, lime usually in the form of limestone is added to the burden to flux the molten iron and to generate a slag. This slag also helps to purge the ash, sulfur and residue or byproduct materials from combustion of the coke. The limestone addition requires a determinable amount of coke to calcine, melt and raise the temperature of the limestone addition, as this is basically an endothermic reaction.

The cupola is a vertically oriented, cylindrical, shaft-type furnace generally having a steel shell and it is somewhat similar in appearance to a blast furnace, but not necessarily analogous in operation. The cupola is the most prevalent furnace utilized in iron foundries for the production of various types of cast iron and may be run as a semi-batch or continuous type operation. The cupola charge or burden materials differ from the blast furnace raw materials as it utilizes steel scrap, iron scrap and pig-iron rather than iron ore. Also, a cupola has tapholes and runners for the slag and molten metal, but generally does not operate with a pressurized feed hopper like a blast furnace. All of these physical characteristics bear evidence to the similarities of these furnaces.

The cupola blast air system is not unlike that of a blast furnace, as it introduces combustion air for the coke into the furnace through tuyeres. The blast air is introduced to the cupola volume at a lower pressure, such as in the range of about 10 to 80 ounces per square inch above atmosphere, through the tuyeres. The coke is burned and the metallic charge is melted. Carbon control in the as-tapped molten metal is broadly a function of the amount of coke charged to the furnace and the carbon present in the charged iron and steel scrap.

In the processing of materials for charging to a cupola, the raw material additions are frequently sized by screening or other means to provide a more uniform material component and to avoid the introduction of small sized additions, which may oxidize rapidly outside the melting zone or be entrained in the gaseous emissions discharge for entrapment in a baghouse. As a specific example, coke may be screened to minimize addition to the furnace of materials which are less than about one and three-quarter inches in diameter. The screened discards are set aside for temporary storage prior to resale to a vendor, but are generally not utilized in the cupola furnace because of their relatively small size.

Metallurgical coke is an expensive commodity and the losses of the screened material may be as high as ten or twenty percent. Further, the screened coke discard material is susceptible to moisture pickup from outside storage, and both the undersize condition and moisture content are regarded as detrimental to a furnace operation. The introduction of moisture to a cupola results in heat losses, as it requires heat to evaporate the water, which consequently requires the addition of more coke and, therefore, the entrained sulfur and ash to the furnace. Thus, it is apparent that dry coke additions are generally easier on the furnace operator, give more consistent results and are, consequently, more desirable.

Historically the cupola operator has had to find supplemental uses for the screened coke discards or frequently has had to find a secondary vendor for these materials. As an example, metallurgical coke may cost $180 per ton but the undersized discards are only resalable for about $25 per ton, which results in lost material, handling, storage, recovery and replacement costs. Therefore, furnace operators have continuously tried to find methods and apparatus to utilize these screened and discarded materials. One known use of these discarded material additions is in the production of iron sinter in sintering plants of steel mills, which use discarded iron, lime and coke fines to produce a material acceptable for charging to a blast furnace. Unfortunately, this is an expensive operation, which was used to consume all the chemically valuable raw materials that were physically unchargeable to furnaces. Many of these sintering plants have been abandoned as they are difficult to run and maintain, and the cost of handling the air emissions from these plants may be disproportionate to, the gains from their operations.

Indicative of various methods devised to utilize coke and coal are a coal-oil slurry method disclosed in U.S. Pat. No. 4,030,894. Other methods utilize finely pulverized coke and coal additions, which may be introduced in a carrier gas stream for entrainment in the hot-blast gasses. However, any of these noted methods require comminuting the coke or coal to a size such as 100 mesh by down or similar size. In addition, the material must be dried prior to furnace introduction, the moisture content must be carefully controlled, or such moisture must be otherwise accommodated. The materials are usually introduced through the furnace tuyeres by a secondary, cold-air, gas carrier. Again, as in a sintering operation, there is a secondary handling and processing of the addition prior to its introduction to the furnace. Another impediment to the utilization of these materials in the furnace operations is the education of the operators to accommodate their introduction and the consequent effects upon both the heat and mass balance, the temperature variations and resultant chemical changes of both the slag and molten metal. Consequently, there has been a reticence to utilize these secondary materials as furnace additions because of the added costs and disruptions to presently accepted operating practices.

SUMMARY OF THE INVENTION

The present invention provides a method and apparatus for the introduction of various material additions to a vertical shaft furnace through the blast-air tuyeres without the use of secondary operations, or ancillary air transport equipment. Various screened and moisture-laden materials may be gravity-charged to the tuyere at a predetermined rate to permit entrainment in the blast media, which avoids using secondary air or pneumatic transport equipment. In the specific example of coke additions to the cupola for the manufacture of cast iron, it is unnecessary to screen or dry the coke prior to making the additions, thereby avoiding a secondary operation, such as drying, comminution or mixing, while making use of available carbon sources. Raw material losses are reduced and total carbon recovery at the tap hole is found to be approximately 2.0% or more, which thereby avoids excess ladle additions to obtain the desired end-point carbon level in the molten iron.

The equipment utilizes a sealed feeder-hopper, which operates at a pressure greater than atmosphere, and a gravity-feed pipe for communication of the raw materials to the tuyere at a controlled rate for entrainment in the blast media to the furnace at the tuyere level. It has been found that the carbon recovery rate from coke introduced at the tuyere level can be as high as 85% in the tapped metal. This is considerably greater than the normal carbon recovery rate of about 50% of the top-charged carbon in the burden materials. Further, additions of ferrosilicon at the tuyere have resulted in silicon recovery in the molten iron of close to 100% for the silicon charged to the burden at the tuyere line with no negative impact upon the furnace operation either in terms of the temperature or metal chemistry.

The above-noted charging rate for the raw material addition is dependent upon the material to be added, its density, its diameter or relative mesh size, and the desired endpoint chemistry. The maximum size of the added component is preferably in the size of about one-third the inner diameter of the tuyere.

BRIEF DESCRIPTION OF THE DRAWING

In the figures, like reference numerals describe like components, and in the drawing:

FIG. 4 is a schematic illustration of a cupola in cross-section and an alternative embodiment of a feed apparatus; and, FIG. 5 is a plan view of the lower surface of the hopper and feed apparatus of FIG. 1.

DETAILED DESCRIPTION OF THE PREFERRED EMBODIMENT

Figure 1:
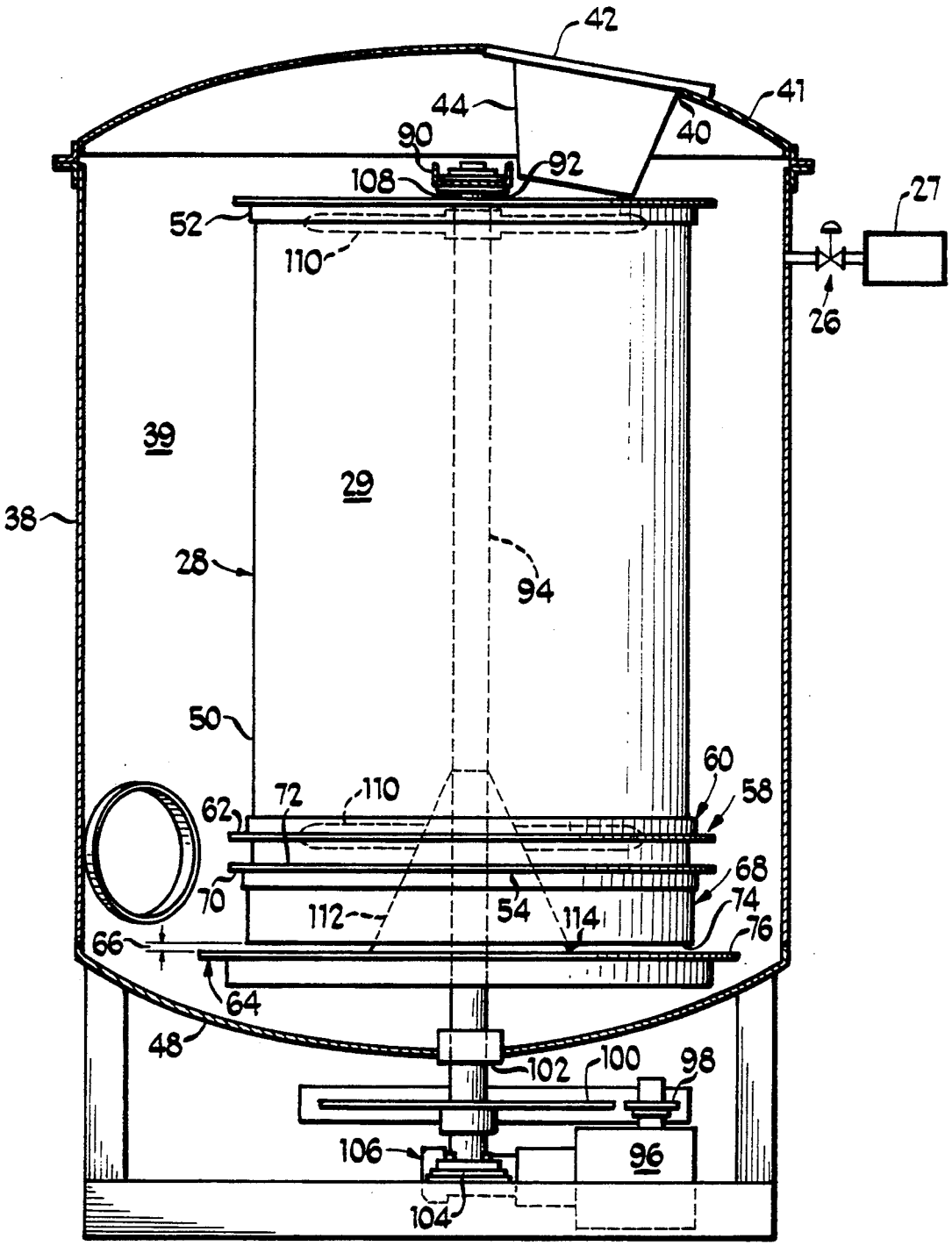
FIG. 1 is an elevational view in cross-section of the pressure-sealed hopper and feed apparatus.

A hopper and feed apparatus for the introduction of coke, ferrosilicon, ferromanganese, aluminum, silicon metal, silicon carbide, silica sand and other material inputs to a vertical shaft furnace and more specifically a cupola will be utilized in the present description. It is recognized that a prime requisite will be the introduction of materials which are smaller than the tuyere inner diameter, and preferably less than one-third the diameter of the tuyere inner diameter to avoid potential blockage of the tuyere.

In FIG. 4, the basic outline of a vertical shaft furnace and more specifically cupola 10 with bustle pipe 12 is shown. Cupola 10 is noted as discontinuous at its top 14 but it is basically open and may have a raw-material charge opening (not shown) in its sidewall 16 in proximity to top 14. Cupola 10 may slightly resemble a cylinder tapering at its lower extremity 15 to a different diameter from top 14. There is a well or hearth region 18 for retention of molten slag and iron. Iron is tapped from well 18 through tap hole 20.

Tuyeres 22 in FIG. 4 are connected to downcomer pipes 24 and bustle pipe 12, and extend through sidewall 16 into melting zone or well 18. In this configuration, blast gasses at a pressure above atmospheric pressure and at a high flow rate are communicated from bustle pipe 12 to melting zone 18 for combustion of the coke in the burden. Coke combustion produces heat and results in the evolution of gaseous materials and ash, which is fluxed from the iron by the slag-forming limestone in the burden. Coke also provides carbon for retention in the molten metal. Although only two tuyeres 22 are shown for purposes of illustration, there are generally a plurality of tuyeres 22 positioned around the well diameter of a furnace or cupola 10.

In the configuration of FIG. 4, additive material feed system 25 has feeder 28 positioned above tuyere 22 and bustle pipe 12 to receive raw material charges for communication to tuyere 22 through conduits 30, 32 and 34, and into tuyere passage 37 for blast media entrainment into melting zone 18 and the burden. As shown, there are no extraneous couplings to hopper 28, conduits 30, 32, 34 or tuyere 22 for any of mechanical, pneumatic or hydraulic transfer of raw material charges to the burden. In the preferred embodiment of feed system 25, feeder 28 is positioned in transfer bin 38, as shown in FIG. 1. Chamber 39 of bin 38 has upper port 40 in bin top 41 with seal plate 42 operable to close port 40, which is sealable against open communication with the atmosphere. A tapered or conical funnel 44 extends from port 40 to feeder 28 for transfer of raw materials to feeder 28 from a feed chute or other apparatus (not shown). Discharge port 46 at bin lower surface 48 in FIG. 5 is operably coupled to conduit 30 for communication of raw materials from chamber 39 to tuyeres 22.

Figure 2:
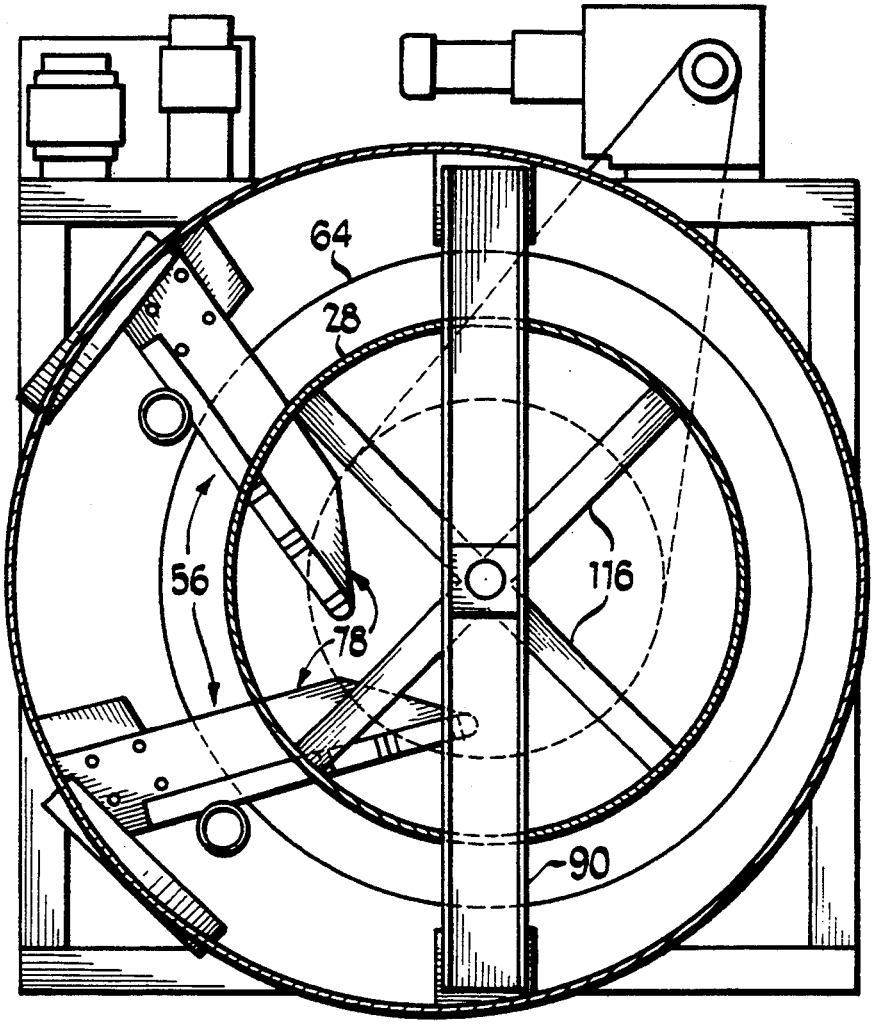
FIG. 2 is a plan view of the hopper and feed apparatus of FIG. 1.

Feeder 28 in FIGS. 1 and 2 is positioned and rotatable in chamber 39. Feeder 28 is a generally cylindrical shell with working volume 29, outer wall 50, upper rim 52 and lower rim 54. Feed-control apparatus 56 has skirt 58 positioned and operable around bin lower rim 54. Skirt 58 has upper segment 60, which may be an annulus secured to bin outer wall 50. Flange 62 radially outwardly extends from upper segment 60 and wall 50, which flange 62 has a plurality of bolt holes therethrough.

Plate 64 is a generally flat circular plate with a diameter greater than the cross-sectional area of the bin cylinder or working volume 29, which plate 64 is mounted below lower rim 54 in chamber 39 and separated therefrom. Second skirt segment 68 is a cylindrical section with a second flange 70 radially extending from its upper edge 72. In FIG. 1, second skirt segment 68 is slidable along outer wall 50 of feeder 28 to vary gap distance 66 between plate upper surface 76 and second-skirt-segment lower edge 74 to vary the discharge rate of raw material from working volume 29 to chamber 39 and discharge port 46.

Figure 3:
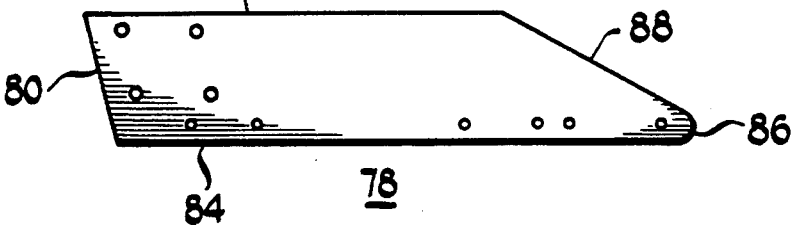
FIG. 3 is an enlarged plan view of the plow of the feeder in FIG. 1.

In FIG. 2, plows 78 of feed-control apparatus 56 are secured to bin 38 in chamber 39 and extend through gap 66 into feeder working volume 29. Plow 78 is shown in an enlarged plan view in FIG. 3, which plow 78 may be a rigid material, such as hot-rolled steel plate with a wall thickness of about three-quarter ($\frac{3}{4}$) inch. Plow 78 is illustrated as generally rectangular with first and mounting edge 80 at an acute angle to the two parallel sides 82 and 84 of the rectangle. Plow leading edge 86 is a rounded projection with tapered surface 88 extending from parallel side 82. In the apparatus of FIG. 1, two plows 78 are noted as positioned and operable in feed-control apparatus 56, although the number of plows 78 and their position are variable by the operator to accommodate the desired feed rate. This feed rate may be dependent upon the rate of operation of cupola 10, the particular additive material and the rate of rotation of feeder 28.

Top bearing support 90 with a central bore 92 extends across chamber 39 and is anchored to bin 38 in FIG. 1. Drive shaft 94 is coupled to drive means, such as a motor 96, sprocket 98 and drive chain 100, and extends through passage 102 of bin lower wall 48. Drive shaft first end 104 is secured in rotatable bearing assembly 106, and second shaft end 108 is secured in central bore 92 of support 90. Stirring rods 110 radially extend from shaft 94 in volume 29 and, as shown in FIG. 6, are located at both the upper and lower level of volume 29. Conical member 112 with its larger diameter end 114 mounted on plate 64 extends into working volume 29, and shaft 94 projects generally through the center of cone 112. In FIG. 2, bracing members 1.16 extend diametrically across volume 29, and in this figure two of members 116 are noted at right angles to each other.

In operation, feeder 28 is filled with the additive raw materials through port 40 and rotated in sealed bin 38 by drive means 96, 98, 100, which is coupled to shaft 94. Lower skirt 68 is raised a predetermined distance above upper surface 76 of plate 64 to provide desired gap distance 66, which may be based upon density of the raw material, its diameter or size, desired feed rate into cupola 10 or any other parameter of the user, as the particular condition utilized to set the feed rate is not a limitation. The material in working volume 29 is transferred through gap 66 by the rotation of feeder 28 and the contact of the fixed plows 78. It is known that plows 78 may be adjusted radially inward or outward to increase or decrease the rate of feed through slot 66 at the same rotational speed of feeder 28. As the material is displaced from feeder 28 to lower wall 48 of chamber 39, it is transferred through discharge port 46 to conduits 30, 32 and 34 at the opening of valve 120 for transfer to tuyere passage 37 and entrainment in the air blast to cupola volume 18 and the burden. The precise location of the addition may vary as there is a constant draft of air in cupola 10, and it has been observed that at least some of the larger or more dense materials contact the burden before being melted, oxidized or otherwise consumed in the melt. No particular mechanism is presently attributed to the interaction of the added materials for the consequent chemical relations noted in the cast iron materials.

As noted above, materials are transferred to feeder 28 and chamber 39 is sealed by seal 42 to allow chamber 39 to operate at the same relative pressure as cupola volume 18. The balanced pressure between chamber 39 and cupola volume 18 is attained by closing valve 120 during raw material charging to working volume 29 and closing seal 42 prior to opening valve 120. This balancing of the pressures between chamber 39 and cupola well 18, although cupola pressures in the melting zone are usually not more than 80 inches of water above atmospheric pressure, allows for a free transfer of materials through conduits 30, 32, 34 with no inhibiting backpressures from furnace 10, which might inhibit gravitational feeding of these materials. Potential pressure leaks at the chamber seals may be compensated for by external pressurization, such as through a pipe and valve arrangement 26 coupled to a source 27 of air at a pressure above atmospheric pressure.

As an example, during brief trials of the feed mechanism on a single tuyere 22, carbon in the form of screened and undersized coke was utilized as the additive raw material, which screened coke was from the coke to be added to the top of cupola 10, and is about less than one and three-quarters inches in size. This undersized coke addition had a relatively high moisture content from outdoor storage, which moisture is generally considered to have a detrimental impact on the operation of smelting furnaces. The results of the tests to date have indicated that the theoretical carbon recovery for carbon (coke) added at tuyere 22 was greater than eighty percent (80%) versus a normal carbon recovery of about fifty percent (50%) for normal carbon additions through the cupola top. This recovery allows for a higher carbon content in the molten iron at the tap hole, which avoids or reduces external carbon additions in the ladle or holding vessel to attain the requisite carbon level in the molten metal. In addition, utilization of the normally rejected materials avoids the loss of the expensive purchased metallurgical coke, while attaining higher recovery rates than is presently experienced with the larger sized materials preferred for the top charging to the burden.

A similar test with ferrosilicon noted that the recovery of silicon from ferrosilicon additions through tuyere 22 provided as much as ninety-five percent (95%) recovery of the silicon in the as-tapped molten iron, which significantly reduces the additions of silicon to the molten metal to attain the requisite silicon specification level. It is considered that other alloy additions can be provided to furnace 10 with other alloying or additive components such as ferromanganese, magnesium, aluminum and silicon metal, and that these additions will positively enhance furnace practices, such as desulfurization, although specific examples of the levels of attainment of these practices are not presently available. As noted, tests to date have shown no negative impact on furnace operation or as-tapped molten metal temperature, and have produced positive impacts on metal chemistry. A precise chemical and thermodynamic balance for any individual cupola furnace is the consideration of the operator. However, the ability to provide the alloying additions to molten metal at tuyere 22 instead of to furnace top 14 has been shown to improve chemical additive recovery utilizing presently available materials and providing access to other currently discardable or limited value materials. Exemplary of the materials perceived as potential candidates for use as carbon alloying additions at tuyere 22 are comminuted vehicle tires. Also, silica sand addition to the melting zone is presently considered a potential source of silicon for the metal.

Although the precise size of material additions utilized to date have been noted above, the acceptable size of additives for transfer through conduits is considered to be additives having a particle size one-third or less than the inner diameter of the transferring conduit, that is tuyere passage 37. As an example, in a six-inch tuyere, it is expected that the materials must be less than two inches in diameter. Further, the optimum feed rate in a vertical shaft furnace is determined by the volumetric rate of the air blast, as an excessive feed rate would not be an acceptable practice in view of the potential to block free passage through tuyere 22. There is also the potential to add an excessive amount of cold mass charge to the furnace and the potential to cause large variations in molten metal chemistry and temperature, which acts are to be avoided.

In an alternative embodiment of the transfer apparatus 56, intermittent charging may be provided by the use of a dual-valve structure as illustrated in FIG. 4. In this figure, first valve 120 is located in the sequence of conduits 30, 32, 34, and second valve 122 is operable positioned between conduits 30 and 32. As a reference condition, first valve 120 is closed when second valve 122 is opened. Feeder 28 is coupled to first conduit 30 for transfer of material to conduit 30 through discharge port 46. With first valve 120 closed, material is communicated from feeder 28, by opening second valve 122, which permits material to flow from feeder 28 and conduit 30 into conduit 32 between first and second valves 120 and 122. Thereafter, second valve 122 is closed and first valve 120 is opened to provide material transfer from conduit 32 to conduit 34, tuyere passage 37 and the furnace burden. The rate of opening and closing transfer valves 120, 122 is dependent upon the rate of material flow from feeder 28 and conduit 30 to the respective conduits 32 and 34, as it is known that fast-response valves may be utilized for this function. Valves 120, 122 may be coupled to a control apparatus 124, such as a computer controlled device, which may include reception of sensed signals from line sensors 130, 132, which are respectively connected to said control device by lines 134 and 136, to note both the full and empty positions of any of conduits 30, 32, 34 and safety sensors (not shown) indicating closed and open positions of valves 120, 122, as known in the art. Valves 120 and 122 are noted as coupled to controller 124 by lines 126 and 128, respectively. It is known that valves 120, 122 are rapidly operable to provide an almost continuous flow of material to tuyeres 22. Although only one bin 38 and feeder 28 system has been shown in the figures, it is apparent that a similar feed system may be coupled to each tuyere 22 to provide multiple raw material feed operations, or that a single feeder 28 and bin 38 could be coupled to more than one tuyere 22.

While only specific embodiments of the invention have been described and claimed herein, it is apparent that various modifications and alterations of the invention may be made. It is, therefore, the intention in the appended claims to cover all such modifications and alterations as may fall within the true spirit and scope of the invention.

We claim:

1. A gravity-feeding mechanism for transfer of alloy additive and burden materials to a vertical-shaft furnace, said furnace having a working volume in a hearth zone with a melting zone for the burden, a well for refined metal, an atmosphere with a pressure above atmospheric pressure, and at least one tuyere for communication of combustion air to the refining and melting zone, said mechanism comprising:

means for holding and means for feeding said materials for charging to said furnace;

means for coupling said at least one tuyere and said holding and feeding means for communication of said materials to said tuyere;

said feeding means operable to provide said materials to said coupling means at a controlled rate of mass transfer for entrainment of said material and communication to said furnace working volume and burden to enhance the burden and additive recovery and the temperature in the hearth zone.

2. In a vertical-shaft furnace for one of smelting and metal refining, which furnace has a top, a hearth and a melting zone, and gas transfer means, an alloy and melt addition apparatus for communication of said alloy and melt additives at the melting zone of said furnace, and a burden charged to said furnace from the top of said furnace, said addition apparatus comprising:

a housing defining a chamber, an input port and a discharge port;

means for sealing said input port;

means for holding and feeding said alloy and other additive materials for charging to said furnace, said means for holding and feeding mounted in said chamber;

means for transferring said additive materials from said means for holding and feeding to said chamber at a fixed rate of discharge from said retaining means;

means for communicating said materials coupled between said discharge port and said gas transfer means, said communicating materials operable to transfer said material by gravity to said gas transfer means for entrainment with gas communicated to said burden at said hearth zone.

3. In a vertical-shaft furnace as claimed in claim 2, said housing is operable to be sealed from the atmosphere by said means for sealing.

4. In a vertical-shaft furnace as claimed in claim 3, wherein said means for holding and feeding has a bin with an outer wall, an upper edge, a lower edge and a first perimeter at said lower edge, said bin rotatable in said housing chamber and defining a fixed volume, a lower plate positioned in said chamber below said lower edge, said lower plate having an upper surface in proximity to said lower edge and a second perimeter extending radially outward of said first perimeter, said lower edge of said bin and said lower:plate upper surface cooperating to define an opening therebetween;

a skirt with a lower rim, said skirt surrounding said first perimeter and vertically extending to said plate upper surface, said skirt vertically slidable along said bin outer wall to define a separating gap between said lower rim of said skirt and said plate upper surface, at least one plow having a generally rectangular elongate shape with a rectangular length and a wall thickness less than the smallest dimension of said rectangular shape, said plow having a leading edge, which has a sloped and tapered length along said rectangular length to said leading edge, said tapered length extending into said bin volume and said gap to promote discharge of said additive materials to said housing chamber during rotation of said bin, said skirt vertically slidable along said bin outer wall to adjust said gap separation for variation of the feed rate of said additive materials discharge to said housing chamber, said communicating means, said gas transfer means and said furnace hearth at a controlled rate.

5. In a vertical-shaft furnace alloy and melt addition apparatus as claimed in claim 2, wherein said furnace is a cupola having a gas pressure greater than atmospheric pressure in the melting zone; said alloy- addition-apparatus housing chamber coupled to said melting zone by said means for communicating, which communicating means is operable to communicate said gas at a pressure to said housing chamber; a source of air at a pressure above atmospheric pressure coupled to said housing chamber, one of said melting zone pressures and source of air pressure communicated to said housing chamber; said housing chamber maintained at said gas pressure above atmospheric by said sealing means to inhibit backdrafting of said additive materials through said gas transfer means and said communication means.

6. In a vertical-shaft furnace alloy and melt addition apparatus, as claimed in claim 5 wherein said additive materials are transferred at a rate to said communicating means and gas transfer means to provide said refined metal at about a desired additive concentration prior to metal discharge from said furnace.

7. In a vertical-shaft furnace alloy and melt addition apparatus, as claimed in claim 6 wherein said refined metal is iron and said additive material is carbon, said carbon additive provided to said furnace as an undried and undersized coke addition from previously rejected material furnace burden additions.

8. In a vertical-shaft furnace alloy addition apparatus, as claimed in claim 7 wherein said coke addition is provided from an undried coke material less than one and three-quarter inches screen size.

9. In a vertical-shaft furnace alloy addition apparatus, as claimed in claim 6 wherein said refined metal is iron and said additive material is carbon, said carbon additive provided to said furnace as comminuted vehicle tires of a size that is less than one and three-quarter inches.

10. In a vertical-shaft furnace alloy addition apparatus, as claimed in claim 6 wherein said refined metal is iron and said additive material may be selected from among coal, coke, silicon, silicon carbide, ferrosilicon, silica sand, magnesium and aluminum, which materials are provided with a screen size less than one and three-quarter inches.

11. In a vertical-shaft furnace alloy addition apparatus, as claimed in claim 10 wherein said material is provided to said gas transfer means at a rate to provide entrainment in said gas stream and unimpeded flow through said gas transfer means.

12. In a vertical-shaft furnace alloy addition apparatus, as claimed in claim 2 wherein said gas transfer means is a tuyere.

13. In a vertical-shaft furnace alloy addition apparatus, as claimed in claim 2 wherein said additive materials are communicated to said gas transfer means and hearth by gravity feed from said housing and said communication means.

14. In a vertical-shaft furnace alloy addition apparatus, as claimed in claim 2 wherein said communication means is a pipe coupling said housing discharge port and said gas transfer means, said housing provided at a height above said gas transfer means for gravity feed of said additive materials through said pipe to said gas transfer means at a rate determined by the rate of transfer of said addition materials from said bin to said housing chamber.

15. A method for transferring alloy additive and burden materials from means for retaining said alloy additive to a vertical-shaft furnace having a working volume with a melting zone for the burden and a well for refined metal, said furnace working volume having an atmosphere with a pressure above atmospheric pressure and at least one tuyere for communication of combustion blast media to the refining and melting zone, said method comprising:

a. positioning said means for retaining alloy additive materials at a vertical elevation above said tuyere;

b. coupling said means for retaining and said tuyere with means for communicating;

c. sealing said means for retaining;

d. balancing approximately equally the pressures in said means for retaining and said furnace working volume;

e. communicating said alloy additive materials by gravity flow at a fixed rate to said tuyere for entrainment in said blast media and transfer to said furnace melting zone and said burden in proximity to said tuyere to enhance the rate of recovery of said additive alloy materials in said refined metal within the furnace and to reduce the requisite furnace-external additions to said refined metal to attain requisite chemical specification limits.

16. A method for transferring alloy additives to a vertical-shaft furnace as claimed in claim 15, said method further comprising sizing said alloy additive materials to said tuyere at a diameter about less than one-third the inner diameter of said tuyere.

17. A method for transferring alloy additives to a vertical-shaft furnace as claimed in claim 15, said method further comprising delivering said alloy additive at a fixed rate to said retaining and communicating means by means for feeding, which is rotatable and adjustable in said retaining means.

18. A gravity-feeding mechanism for transfer of alloy additive and burden materials as claimed in claim 1, said means for holding further comprising a housing defining a chamber and a bin, said bin and means for feeding positioned and operable in said chamber, said housing having a bottom and defining a port in said bottom, said coupling means connected to said port;

said bin operable to receive said alloy additive and said feeding means operable to transfer said alloy additive to said chamber port and coupling means at a controlled rate of mass transfer for communication of said additive to said tuyere and furnace.

19. A gravity-feeding mechanism for transfer of alloy additive and burden materials as claimed in claim 18, said mechanism further comprising means for driving coupled to said feeding means and operable to rotate said feeding means in said chamber and bin.

20. A gravity-feeding mechanism for transfer of alloy additive and burden materials as claimed in claim 18, said means for coupling further comprising means for controlling material flow through said means for coupling.

21. A gravity-feeding mechanism for transfer of alloy additive and burden materials as claimed in claim 20 wherein said means for coupling has at least one conduit for communication of alloy additive material between said housing bottom port and said tuyere;

said means for controlling having at least one valve positioned and operable in said conduit to control flow of alloy additive material between said chamber and said tuyere.

22. A gravity-feeding mechanism for transfer of alloy additive and burden materials as claimed in claim 21 wherein said controlling means has a first valve, a second valve, at least one means for sensing and a controller, each said first and second valve operable between at least an open operational position and a closed operational position;

a first line connecting said first valve to said controller;

a second line connecting said second valve to said controller;

a third line connecting said means for sensing to said controller, which sensing means is operable to sense any of the operational positions of said first and second valves, and the level of material in said conduit and to communicate said sensed signal to said controller;

said controller operable to control said first and second valve between an open and closed position to control the rate of alloy transfer in said conduit from said chamber to said tuyere in response to said sensed signals.

* * * * *